US008464908B1

(12) United States Patent
Tabor

(10) Patent No.: US 8,464,908 B1
(45) Date of Patent: Jun. 18, 2013

(54) MULTI-DIRECTIONAL FLUID DISPENSER

(76) Inventor: Norman W. Tabor, Newburyport, MA (US)

( * ) Notice: Subject to any disclaimer, the term of this patent is extended or adjusted under 35 U.S.C. 154(b) by 202 days.

(21) Appl. No.: 13/029,400

(22) Filed: Feb. 17, 2011

(51) Int. Cl.
*B65D 35/28* (2006.01)
*B65D 37/00* (2006.01)
*B65D 35/56* (2006.01)

(52) U.S. Cl.
USPC ..... 222/95; 222/105; 222/209; 222/211; 222/386.5; 222/464.2

(58) Field of Classification Search
USPC ..... 222/211, 94, 464.2, 105, 209, 386.5, 222/95
See application file for complete search history.

(56) References Cited

U.S. PATENT DOCUMENTS 2,299,572 A * 10/1942 Estenes ..... 222/182
3,240,399 A * 3/1966 Frandeen ..... 222/211
3,698,595 A * 10/1972 Gortz et al. ..... 222/95
4,159,790 A * 7/1979 Bailey ..... 222/211
4,239,132 A * 12/1980 Mueller et al. ..... 222/212
5,332,121 A 7/1994 Schmidt et al.
5,699,920 A 12/1997 Ida et al.
D402,547 S 12/1998 Galecki
6,305,577 B1 10/2001 Fillmore et al.
6,505,986 B1 * 1/2003 Oder ..... 401/183
2006/0226171 A1 10/2006 Sternberg
2009/0224002 A1 9/2009 Bakhos

* cited by examiner

*Primary Examiner* — Kevin P Shaver
*Assistant Examiner* — Conrad Laskowski

(57) ABSTRACT

Presently, when the liquid inside a fluid dispenser (such as a condiment dispenser) is low, a person has to turn the fluid dispenser upside down to cause the fluid to migrate towards the spout for squirting out. The problem associated with having to turn the fluid dispenser upside down is that the fluid can seep through a vent hole and dry up the vent hole when the fluid dries up. The present invention features a fluid dispenser that can dispense a fluid contained therein without having to flip the dispenser upside down to have the fluid migrated to the spout.

1 Claim, 3 Drawing Sheets

TOP VIEW

MULTI-DIRECTIONAL FLUID DISPENSER

BACKGROUND OF THE INVENTION

Presently, when the liquid inside a fluid dispenser (such as a condiment dispenser) is low, a person has to turn the fluid dispenser upside down to cause the fluid to migrate towards the spout for squirting out. The problem associated with having to turn the fluid dispenser upside down is that the fluid can seep through a vent hole and dry up the vent hole when the fluid dries up. The present invention features a fluid dispenser that can dispense a fluid contained therein without having to flip the dispenser upside down to have the fluid migrated to the spout.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
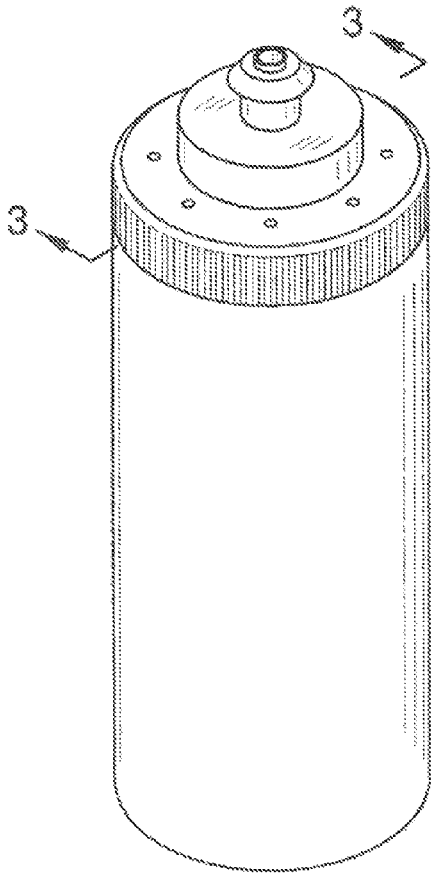
FIG. 1 shows a perspective view of the multi-directional fluid dispenser.
Figure 2:
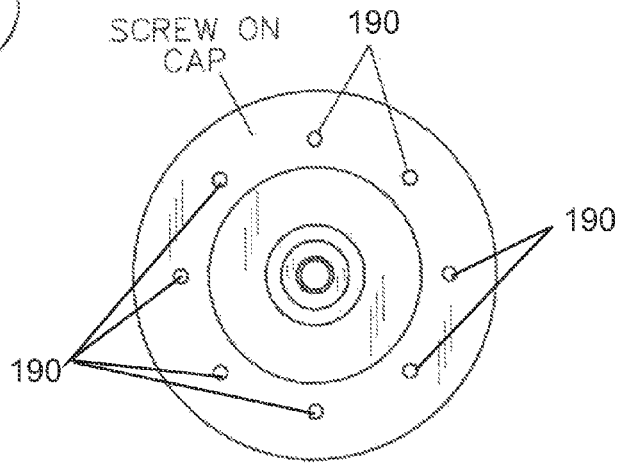
FIG. 2 shows a top view of the multi-directional fluid dispenser.
Figure 3:
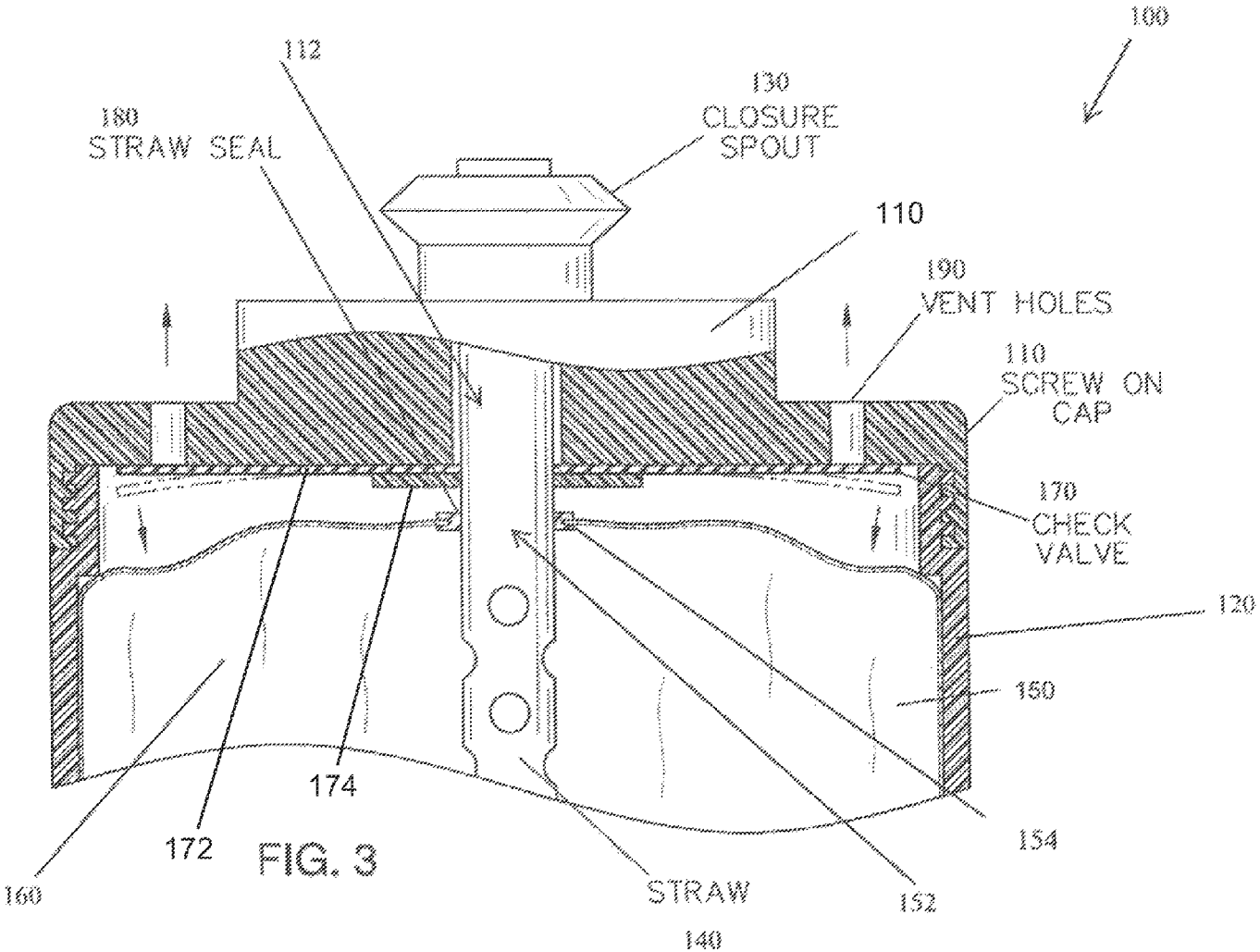
FIG. 3 shows a side cross sectional view of the multi-directional fluid dispenser.
Figure 4:
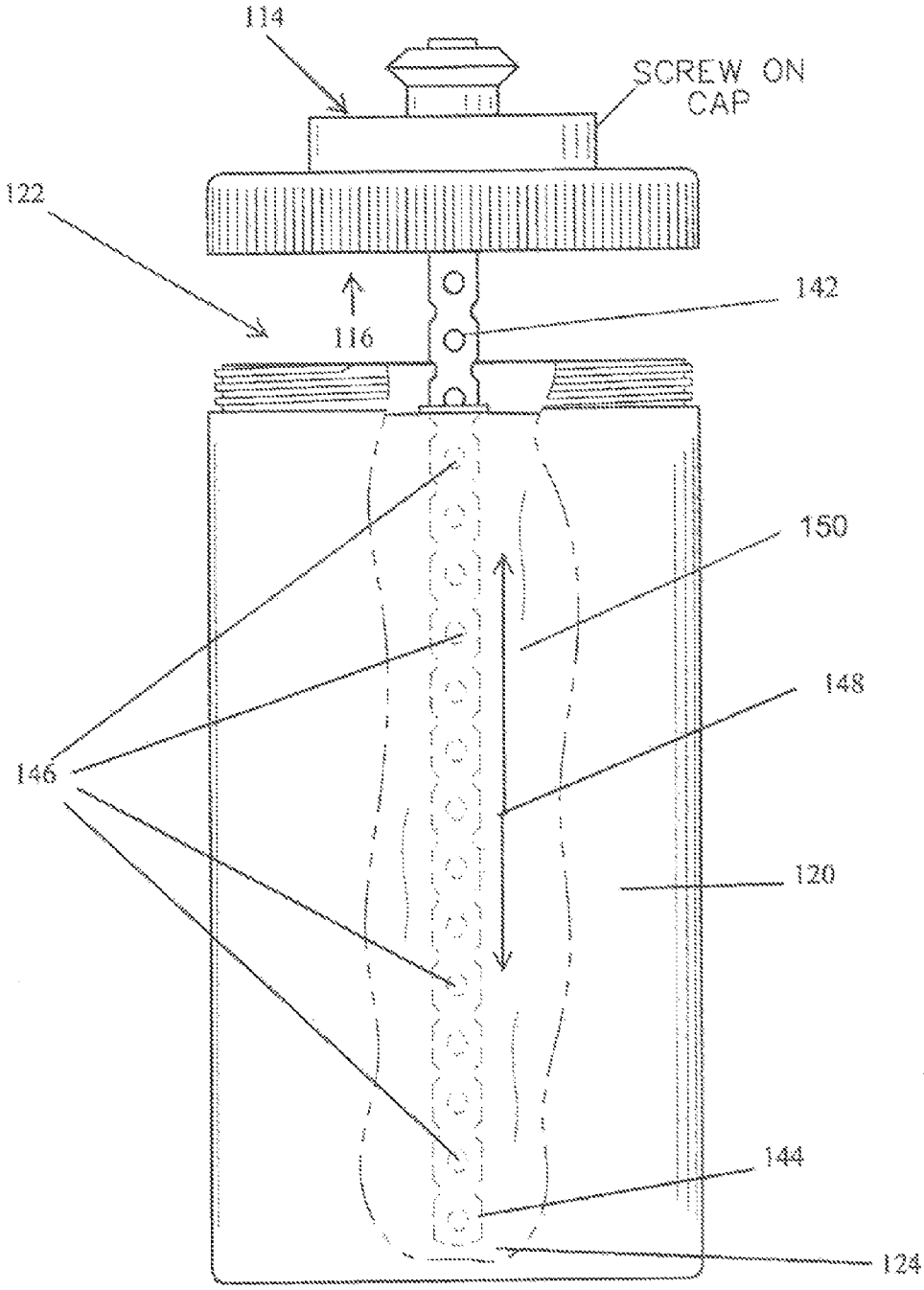
FIG. 4 shows a cut-away view of the multi-directional fluid dispenser.

Referring now to FIGS. 1-4, the present invention features a multi-directional fluid dispenser 100. In some embodiments, the multi-directional fluid dispenser 100 is a condiment dispenser. In some embodiments, the multi-directional fluid dispenser 100 is a beverage dispenser.

In some embodiments, the multi-directional fluid dispenser 100 comprises a cap 110 covering an opening 122 of a squeezable container 120. The cap 110 is secured to the squeezable container 120. The multi-directional fluid dispenser 100 cap further comprises a channel 112 extending through the cap 110, wherein the channel 112 fluidly connects a closure spout 130 that extends upwardly kohl the cap 110 at a top cap side 114 with a perforated straw 140 that extends downwardly from the cap 110 at a bottom cap side 116.

In some embodiments, the perforated straw 140 has a first end 142 and a second end 144. The first end 142 is disposed towards the cap 110 and the second end 144 is disposed towards a bottom surface 124 of the squeezable container 120.

The multi-directional fluid dispenser 100 further comprises a bag 150 enveloping the perforated straw 140. The first end of the perforated straw 142 pierces through the bag through a bag aperture 152 wherein the second end of the perforated straw 144 remains inside the bag 150. A fluid 160 (e.g., a condiment, a beverage, etc.) is contained in the bag 150 to be dispensed. In some embodiments, the multi-directional fluid dispenser 100 further comprises one or more vent holes 190 disposed on the cap 110.

Operationally, when the squeezable container 120 is compressed, the squeezable container 120 compresses against the bag 150 and causes fluid 160 to enter the perforated straw 140 and is then squirted out through the closure spout 130. One of the advantages of the present invention is that the multi-directional fluid dispenser 100 can dispense the fluid readily even when the fluid resides at the bottom end of the squeezable container. The user does not have to flip the bottom end of the squeezable container above the closure spout as is traditionally required.

The multi-directional fluid dispenser of claim 1 wherein the cap 110 is a screw on cap for securing to the squeezable container 120. The multi-directional fluid dispenser of claim 1 wherein the perforated straw 140 comprises apertures 146 along the length of the straw. The multi-directional fluid dispenser of claim 1 wherein the bag 150 envelops an entire length 148 of the perforated straw that is disposed within the squeezable container 120. The multi-directional fluid dispenser of claim 1 further comprising a check valve 170 disposed on the bottom side of the cap 116 and the check valve flaps over the vent hole 190. The multi-directional fluid dispenser of claim 1 wherein a seal 180 is disposed between a lip 154 of the bag aperture 152 and the perforated straw 140.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A multi-directional fluid dispenser (100) consisting of:

(a) a screwed cap (110) covering an opening (122) of a squeezable container (120), the screwed cap (110) is secured to the squeezable container (120);

(b) a channel (112) extending through the cap (110), the channel (112) fluidly connecting a closure spout (130) extending upwardly from the cap (110) at a top cap side (114) with a perforated straw (140) comprising a plurality of apertures (146) along the length of the straw extending downwardly from the cap (110) at a bottom cap side (116), the perforated straw (140) having a first end (142) and a second end (144), the first end (142) is disposed towards the cap (110) and the second end (114) is disposed towards a bottom surface (124) of the squeezable container (120);

(c) a bag (150) enveloping a length (148) of the perforated straw (140) that is disposed within the squeezable container (120), the first end of the perforated straw (142) pierces through the bag through a bag aperture (152), the second end of the perforated straw (144) remains inside the bag (150), a fluid (160) is contained in the bag (150) to be dispensed, wherein a seal (180) is disposed between a lip (154) of the bag aperture (152) and the perforated straw (140);

(d) eight vent holes (190) disposed on the cap (110), wherein the holes are radially and uniformly around the closure spout (130); and (e) a circular check valve disk (172) disposed on the bottom side of the cap (110), wherein the check valve disk (172) is supported by a circular support disk (174) adjacently below the check valve disk (172), wherein the check valve disk (172) and the support disk (174) are centered around and contact the straw (140), wherein the support disk (174) is smaller in diameter than the diameter of the check valve disk (172) such that the check valve disk (172) flaps over the vent holes (190) to form eight check valves (170);

wherein when the squeezable container (120) is compressed, the squeezable container (120) compresses against the bag (150) and causes fluid (160) to enter the perforated straw (140) and is then squirted out through the closure spout (130).

* * * * *